US005295871A

United States Patent [19]

Lapraik et al.

[11] Patent Number: 5,295,871

[45] Date of Patent: Mar. 22, 1994

[54] HIGH DENSITY CABLE CONNECTOR ASSEMBLY

[75] Inventors: Scott J. Lapraik, Spartanburg; Eric D. Juntwait, Moore, both of S.C.

[73] Assignee: Thomas & Betts Corporation, Bridgewater, N.J.

[21] Appl. No.: 890,449

[22] Filed: May 29, 1992

[51] Int. Cl.[5] ..... H01R 13/432

[52] U.S. Cl. ..... 439/746; 439/752; 439/891

[58] Field of Search ..... 439/284, 290, 291, 405, 439/595, 626, 660, 682, 686, 692, 733, 744–749, 751, 752, 678, 891

[56] References Cited

U.S. PATENT DOCUMENTS

| | | | |
|---|---|---|---|
| 2,822,529 | 2/1958 | Heath | 339/258 |
| 3,359,533 | 12/1967 | Barry | 339/217 |
| 3,389,371 | 6/1968 | Maynard | 339/192 |
| 3,544,954 | 12/1970 | Yeager | 339/217 |
| 3,550,067 | 12/1970 | Hansen | 439/748 |
| 3,686,617 | 8/1972 | Uberbacher | 439/291 |
| 3,915,538 | 10/1975 | Grohn, Jr. et al. | 339/75 |
| 4,083,615 | 4/1978 | Volinskie | 339/17 |
| 4,255,009 | 3/1981 | Clark | 339/97 |
| 4,274,700 | 6/1981 | Keglewitsch et al. | 439/682 |
| 4,557,543 | 12/1985 | McCleerey et al. | 339/97 |
| 4,636,020 | 1/1987 | Marmillion | 439/595 |
| 4,891,021 | 1/1990 | Hayes et al. | 439/599 |
| 4,957,451 | 9/1990 | Nadin | 439/395 |
| 4,984,998 | 1/1991 | Duncan | 439/595 |
| 5,052,949 | 10/1991 | Lopata et al. | 439/610 |
| 5,082,461 | 1/1992 | Minnis et al. | 439/786 |
| 5,118,306 | 6/1992 | Bixler et al. | 439/405 |

FOREIGN PATENT DOCUMENTS 858692 1/1961 United Kingdom .

OTHER PUBLICATIONS

SCSI-2 Draft Proposed American National Standard pp. (4-3)-(4-24), Mar. 9, 1990, Revision 10c.

Product Line Catalog, Holmberg Electric Corporation, Cover Sheet and pp. 22-23 (undated).

*Primary Examiner*—Neil Abrams

*Attorney, Agent, or Firm*—Robert M. Rodrick

[57] ABSTRACT

A high density electrical connector is provided for supporting a plurality of contact assemblies in a geometric array, each contact assembly comprising a conductive contact portion, a retention portion, a vertical offset portion and a conductive connection portion. The contact portions are disposed in side by side positions along n rows across the connector. An insulative housing is provided having a rear wall, a forward wall and a plurality of contact assembly support cavities extending between the rear and forward walls. Each support cavity has a contact retention rib which engages the retention portion of the contact assembly. Each support cavity also has an elongate contact entry opening in the rear wall, the entry openings being disposed along n pairs of rows in a staggered array, with adjacent cavities in each pair of rows being alternately upright and inverted. The entry openings for upright cavities in a pair of rows lie along a first center line. The entry openings for inverted cavities lie along a second center line offset from the first center line by a distance less than height of the contact entry openings such that the inverted and upright cavities in each pair of rows are interleaved.

12 Claims, 7 Drawing Sheets

HIGH DENSITY CABLE CONNECTOR ASSEMBLY

BACKGROUND OF THE INVENTION

Recently, proposals have been made for adoption of standards for high density, multi-terminal electrical connectors of a type identified as "Small Computer Standard Interface" (SCSI) connectors. The most recent standard (American National Standard), identified as SCSI-2 (the "2" signifying a second generation), specifies a set of dimensions for male and female connectors of this type, as well as the assignment of particular functions to specific ones of the terminal contacts. Arrangements such as fifty contact or sixty-eight contact connectors are contemplated in the SCSI-2 standard. The "high density" characteristic of these connectors is related to the fact that the contacts are arranged, for example, in two equal, parallel rows (either twenty-five contacts per row or thirty-four contacts per row) with adjacent contacts (or pins) spaced 1.27 millimeters (0.050 inches) apart. Prior to this proposal, connectors of this general type employed a pitch (spacing) twice as great (i.e., 0.100 inches).

Where close spacing of pins or contacts is required, so-called "IDC" (insulation displacing contact) configurations generally are employed (see U.S. Pat. No. 5,052,949, Lopata et al., granted Oct. 1, 1991 for one representative IDC arrangement). Where an IDC configuration is used, particular attention must be paid to accurate insertion of the individual wires of a cable into the knife-edge contacts which serve to displace the insulation from the wire to insure that good electrical contact is made, while at the same time, insuring that the wire is not excessively weakened when the knife-edge cuts into the wire. Use of an IDC arrangement also imposes a requirement that variations in the diameter of wires and insulation for a given connector assembly be relatively small. Special assembly tools generally are also required for each different IDC cable configuration.

An alternative to the use of an IDC contact is a so-called "crimp/snap" contact as is generally shown, for example in U.S. Pat. No. 3,389,371—Maynard, granted Jun. 18, 1868, or U.S. Pat. No. 3,915,538—Gruhn et al., granted Oct. 28, 1975 or U.S. Pat. No. 4,557,543—McCleerey et al., granted Dec. 10, 1985 (see also, Product Line Catalog, Holmberg Electric Corporation, Inman, S.C., pages 22–23). Crimp/snap contacts provide for relative ease of assembly, superior electrical characteristics and the ability to withstand greater physical abuse than IDC contacts. However, crimp/snap contacts employ barrel-shaped crimping flanges which surround the outside of the insulation of a wire, the crimping flanges themselves being conductive and connected to (generally integral with) the portion of the contact which directly engages the uninsulated conductive wire. The relatively large diameter of the conductive crimping flanges (as compared to the smaller diameter of the associated conductor) generally requires greater wire to wire spacing and, heretofore, precluded the use of a crimp/snap cable connector in a high density assembly, as that term is defined above.

SUMMARY OF INVENTION

In accordance with one aspect of the present invention an array of contact members is arranged in a plurality of horizontally aligned sets in an insulative housing by means of crimp snap contacts in which the crimp barrel is offset vertically from the axis of the contact and horizontally adjacent contact members are disposed in alternating inverse orientations. The associated insulative housing includes contact entrance openings interleaved in a staggered array along horizontal lines which are vertically displaced from each other, the number of horizontal lines being twice the number of lines along which contact pins (or sockets) are aligned at exit openings in the housing.

While the various aspects of the present invention will be described hereinafter in terms of a preferred embodiment, it should be recognized that various modifications may be made without departing from the invention, the scope of which is set forth in the appended claims.

DETAILED DESCRIPTION

Figure 1:
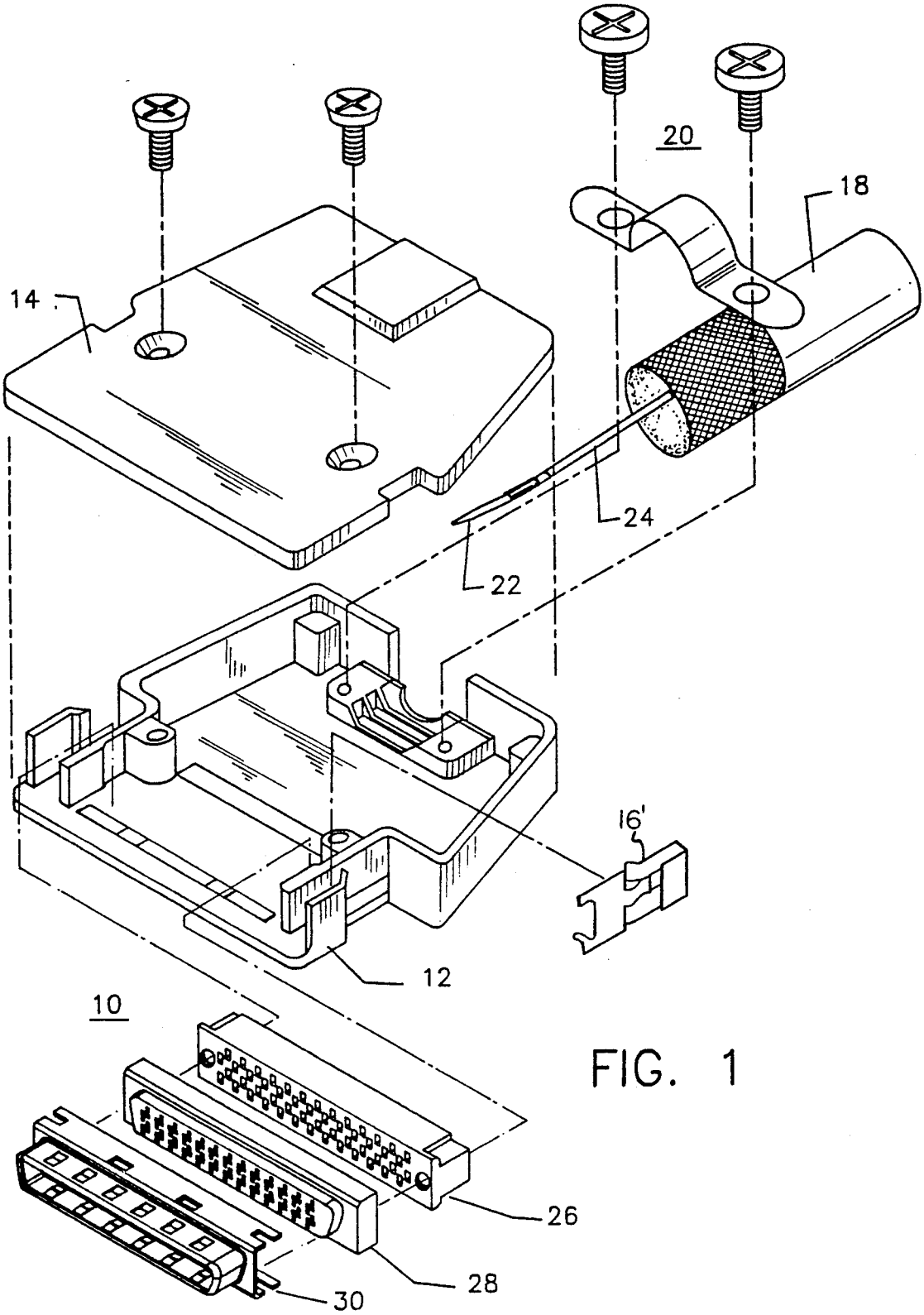
FIG. 1 is an exploded perspective view, partially in schematic form, of a high density cable connector assembly constructed in accordance with the present invention.

Referring to FIG. 1 of the drawing, a multicontact crimp/snap cable connector assembly constructed in accordance with the present invention is illustrated.

The overall assembly comprises a three piece insulator/shell subassembly indicated generally by the reference numeral 10, a backshell base 12 and cover 14, first and second retaining spring clips 16 and 16', a multiconductor shielded cable 18, a strain relief kit 20 and a plurality (e g., 50 or 68) of Crimp snap contact assemblies 22, each associated with a separate individual conductor 24 within cable 18. The manner of assembly of the several components illustrated in FIG. 1 is shown by means of the broken lines. The backshell base 12 and cover 14 preferably are die cast from a suitable metal, spring clips 16, 16' preferably are stainless steel, the shell (forwardmost) portion of subassembly 10 is steel and the insulator portions 26, 28 are suitable ULapproved thermoplastic electrical insulating material such as polyester.

Figure 2:
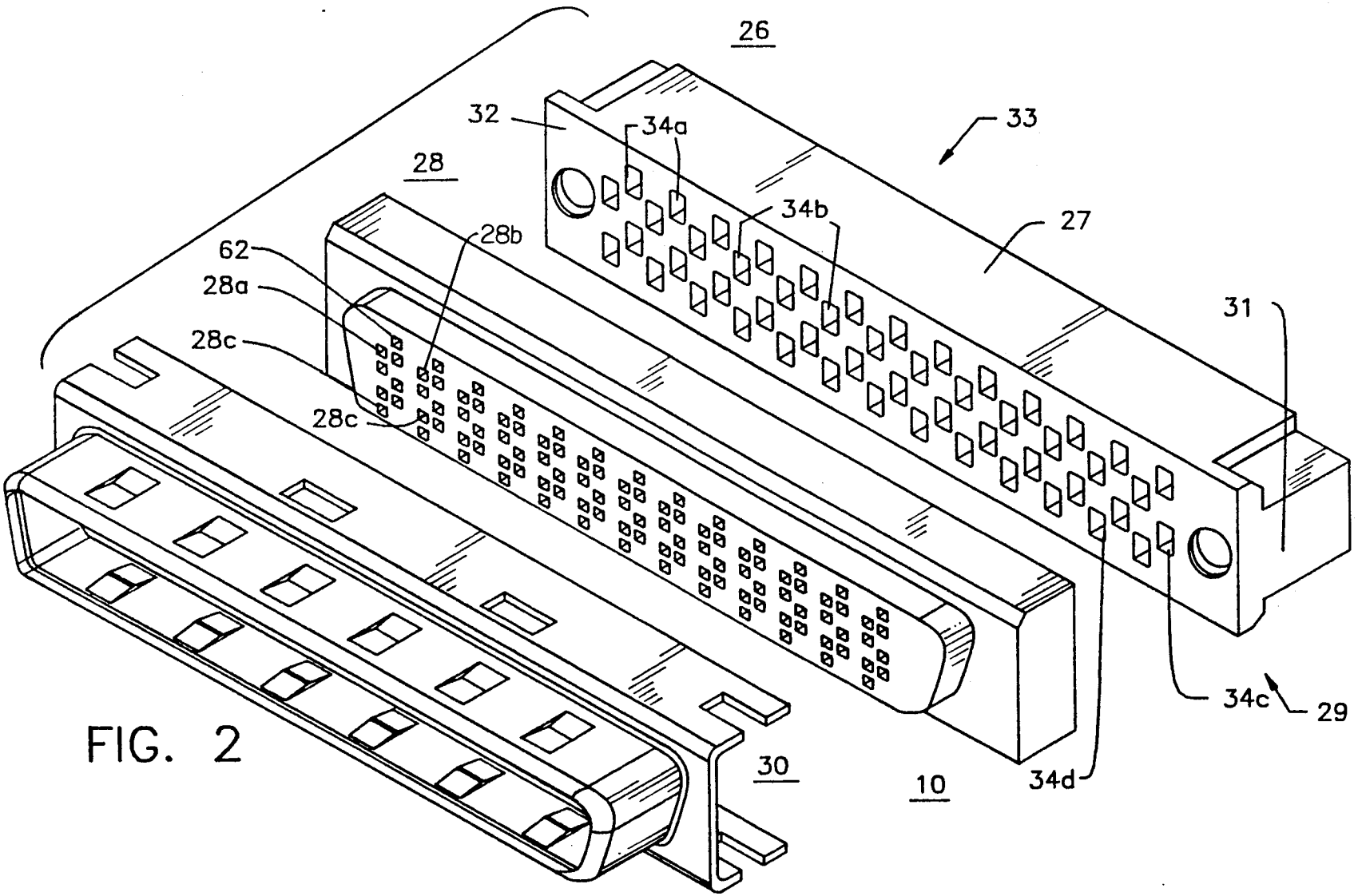
FIG. 2 is an enlarged view of the three piece insulator/shell subassembly shown in FIG. 1.

The insulator/shell subassembly 10 is shown in greater detail in FIG. 2. Subassembly 10 comprises an insulative portion comprising an insulator base housing 26, and an insulator cover 28, and a metal shell 30 which nest together to receive, support and position a predetermined plurality (illustrated as fifty) of crimp snap electrical contact assemblies 22 (see FIGS. 5 and 6) to form a high density SCSI-2 connector.

The insulator base housing 26 comprises a unitary assembly molded from a suitable plastic material having electrical insulative properties. Housing 26 has a top wall 27, a bottom wall 29, side walls 31, a front mating surface and a rear wall or contact receiving surface 33 (see FIG. 3*a*).

An array of through openings or cavities 34*a*, 34*b*, 34*c* and 34*d* for receiving and supporting contact assemblies are provided between front surface 32 and rear surface 33 of base housing 26. In a fifty contact connector, there are thirteen cavities 34*a*, twelve cavities 34*b*, thirteen cavities 34*c* and twelve cavities 34*d*.

Figure 3A:
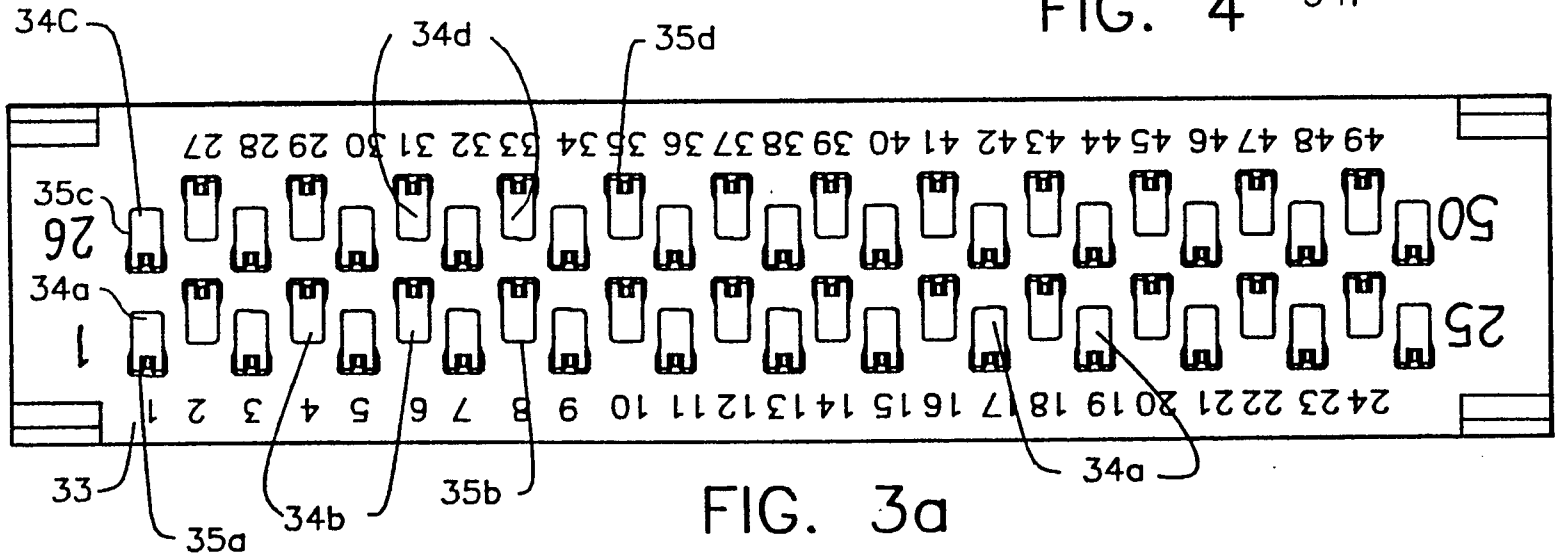
FIGS. 3*a*, 3*b*, and 3*c* respectively, a rear view, a top view and a front view of the insulator base housing shown in FIGS. 1 and 2.
Figure 3B:
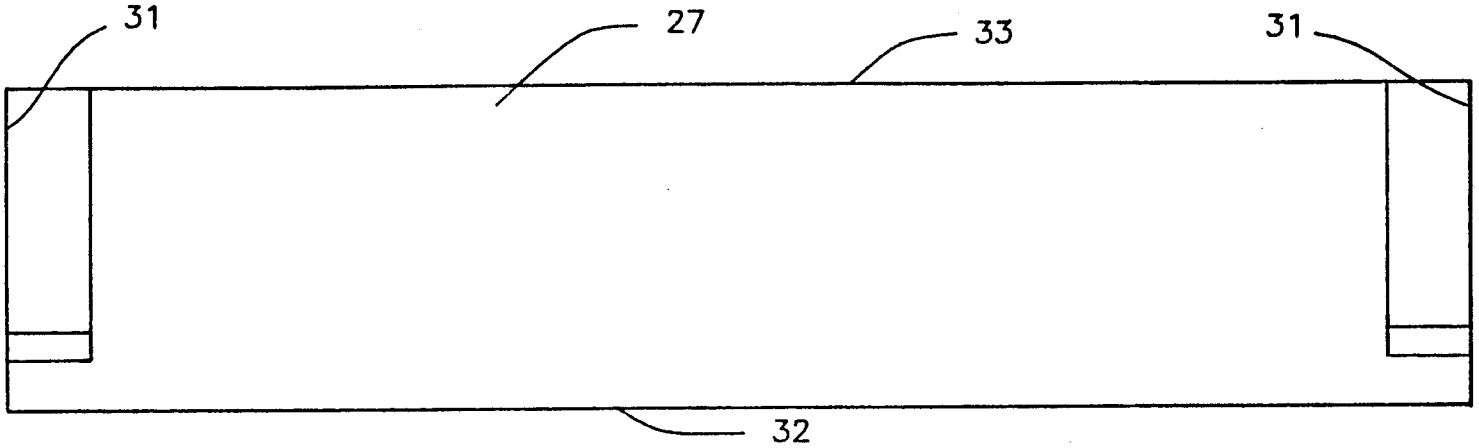
Figure 3C:
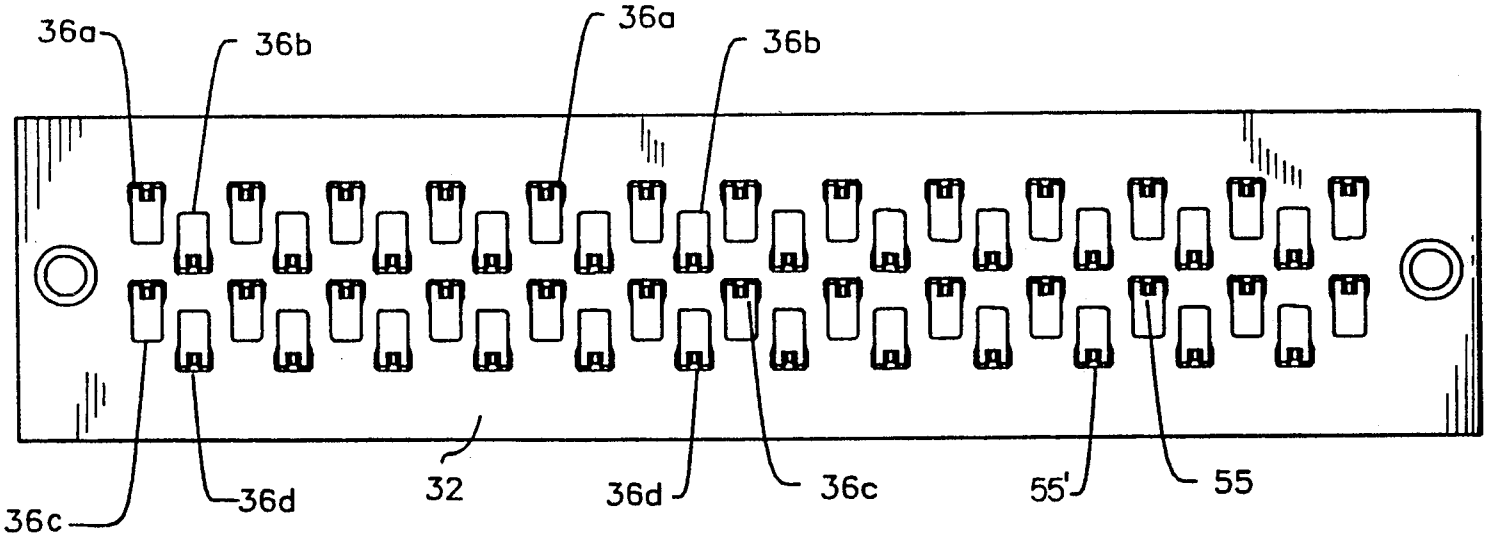

Each of the cavities 34*a–d* has a corresponding vertically-elongated contact entry opening 35*a*, 35*b*, 35*c* and 35*d* in contact receiving surface 33 (see FIG. 3*a*) and a corresponding contact exit opening 36*a*, 36*b*, 36*c*, 36*d* in front mating surface 32 (see FIG. 3*c*). The cavities 34*b* and 34*d* are identical in interior configuration (see FIG. 7) while cavities 34*a* and 34*c* (see FIG. 5) are identical to each other but are inverted (or reversed) relative to cavities 34*b* and 34*d*, as will be explained in greater detail below. All of the entry openings 35*a* are aligned in a row along a first common horizontal line; all of the entry openings 35*b* are aligned in a second row along a second common horizontal line offset below the first line; all of the entry openings 35*c* are aligned in a third row along a third common horizontal line offset below the second line and all of the entry openings 35*d* are aligned in a fourth row along a fourth common horizontal line offset below the third line.

The resulting array of entry openings 35*a*, 35*b*, 35*c* and 35*d* in base housing 26 comprises a staggered array of openings along four horizontal lines in which vertically aligned pairs of openings (e.g., 35*a*, 35*c* or 35*b*, 35*d*) are identical in interior configuration. Horizontally adjacent openings (e.g., 34*c*, 34*d* or 34*a*, 34*b*) are inverted with respect to each other (i.e., are alternately upright and inverted) and are vertically offset from each other in a staggered arrangement. As will be pointed out below, the foregoing arrangement permits closer spacing (smaller pitch) of adjacent contact assemblies 22 while, at the same time, providing a required thickness of insulating wall and required physical spacing between maximum diameter conductive portions (such as insulator crimp barrel portion 41—see FIG. 5) of adjacent contact assemblies 22.

Figure 5:
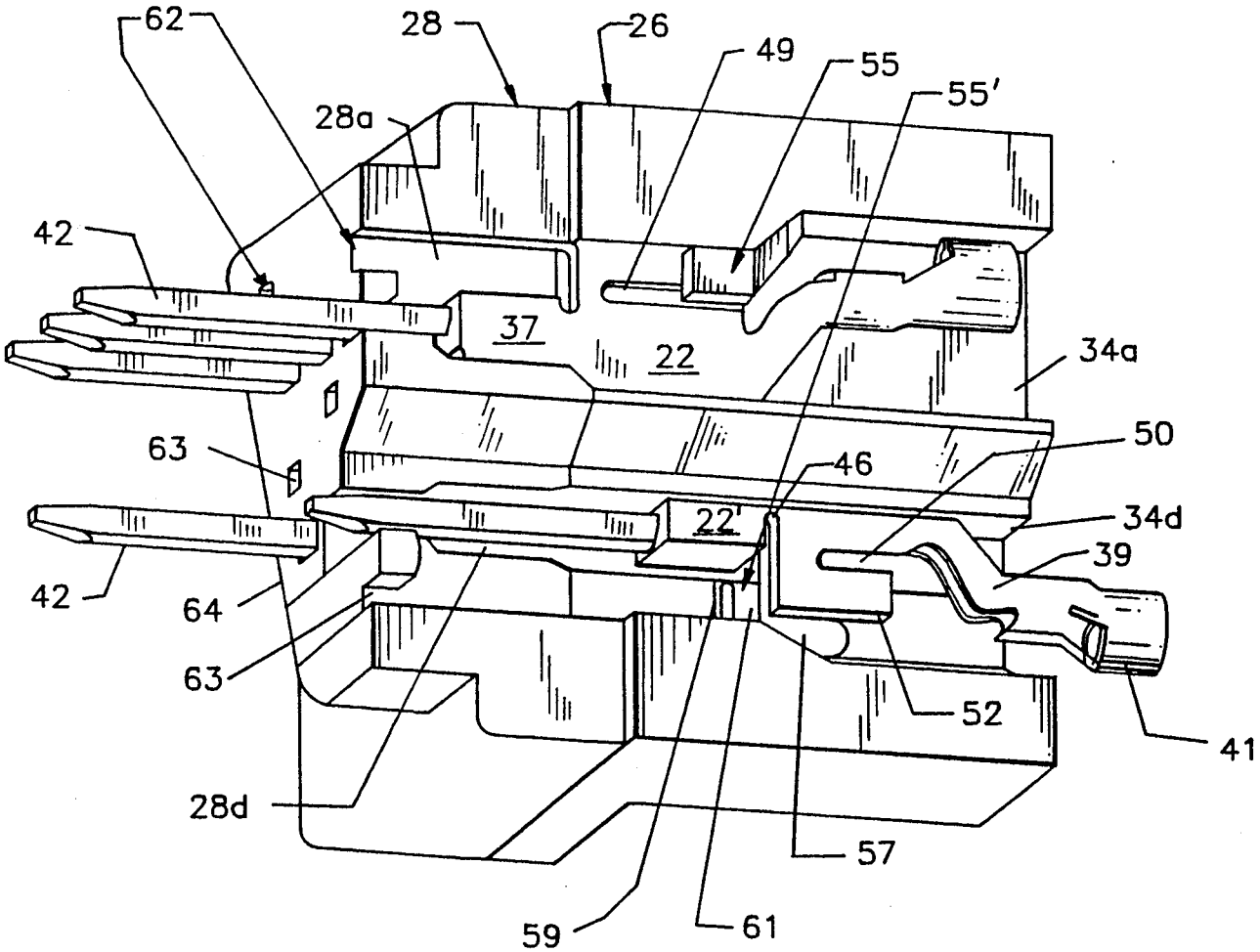
FIG. 5 is an isometric view, partially broken away, of a portion of a connector assembly constructed according to the present invention in which one contact is partially inserted into its cavity and associated conductive wires have been omitted.
Figure 6:
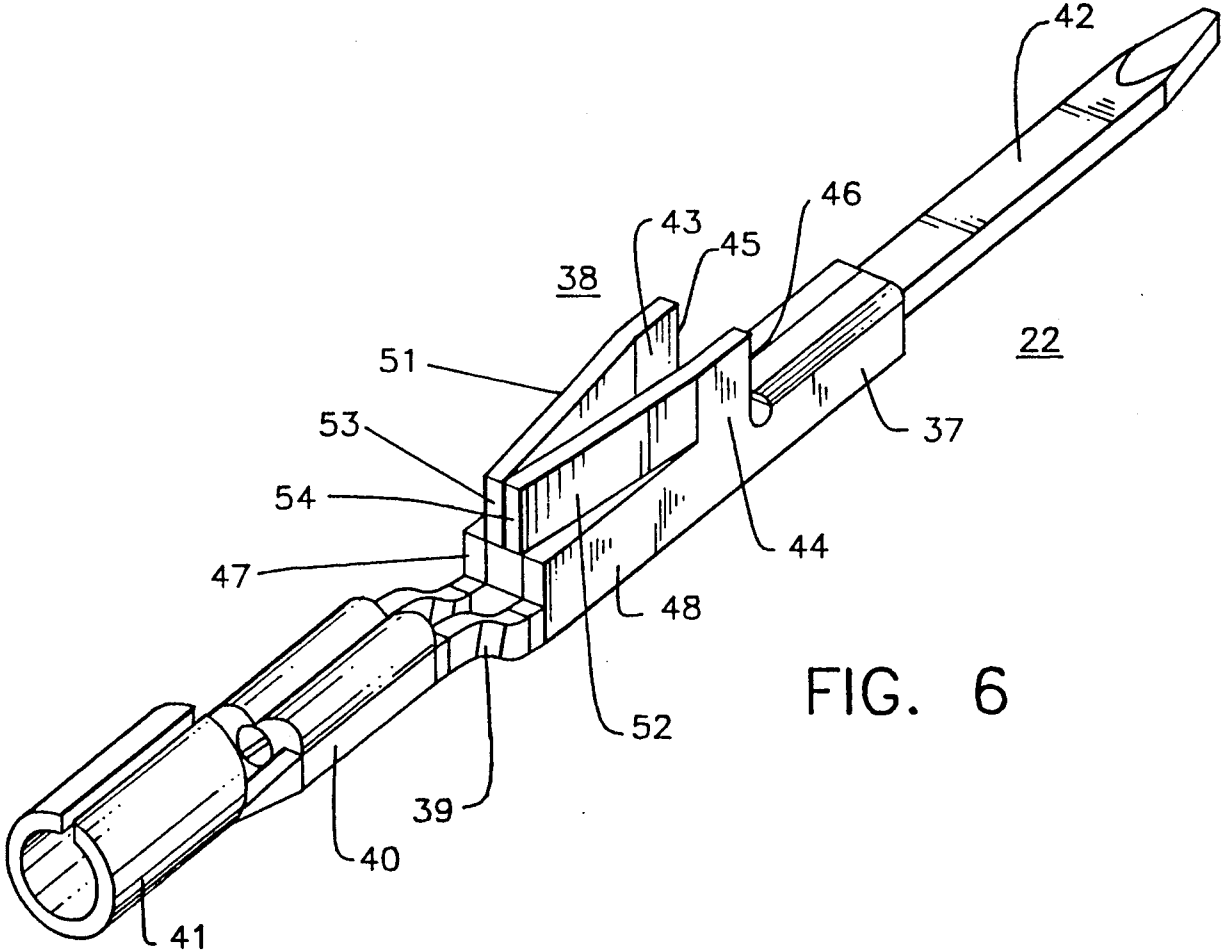
FIG. 6 is an isometric view of a crimp/snap contact constructed to the present invention.

As is shown most clearly in FIGS. 5 and 6, the contact assembly 22, which may be made of flat folded, rolled or bent conductive sheet stock (typically brass or bronze), comprises, from front to rear, a forward box-shaped portion 37, a constricted locking or retention portion 38, a vertical offset portion 39, a conductor connection portion or crimp barrel 40 for engaging a wire conductor 24 and an insulator crimp barrel 41 for captivating an insulator coating surrounding an associated conductor 24 (FIG. 1).

The forward box-shaped portion 37, in the illustrated case of a male contact, is arranged to be crimped around an elongated, forwardly extending, flat, blade-shaped conductive mating pin or contact pin 42. Where a female connector is involved, the blade shaped pin 42 would be replaced by an integral complementary shaped conductive contact sleeve (not shown). As illustrated, the pin 42 is formed separately, an arrangement which is advantageous since the pin 42 can be made of hard, durable, wear resistant conductive material to withstand the abuse of repeated mating cycles while the remainder of the contact assembly 22 may be formed of a different material which is selected to be ductile to facilitate forming and crimping. Pin 42 may also include coined retention ribs (not shown) which engage the inside of box-shaped portion 37 to provide increased resistance against undesired axial "pull-out" (removal) of the pins 42 from the assembly 22. It should also be recognized that the pin 42 may be formed integrally with the remainder of the contact assembly 22 using multigage material where required. That is, the pin 42 may be of a different thickness (gage) compared to the remainder of the contact assembly 22, further insuring against unwanted contact breakage.

The crimp barrels 40 and 41 at the rear end of contact assembly 22 have respective longitudinal center lines which are vertically offset from the center line of pin 42 as will be explained below.

As can be see in FIG. 1, a separate wire 24 from a multiwire cable 18 is connected to each contact assembly 22. Each wire 24 is connected by stripping a length of outer insulator coating from the wire 24 for a length substantially equal to or slightly greater than the length of conductor crimp barrel 40 (e.g., 0.050 inches). The stripped wire end is inserted through insulator crimp barrel 41 and conductor crimp barrel 40. At that point, the outer insulator jacket of wire 24 will be within insulator crimp barrel 41. The crimp barrels 40 and 41 are then appropriately squeezed or coined to captivate the wire 24 and to make suitable electrical contact with the stripped end portion thereof. The desired stripping/crimping operations described in general terms above may be accomplished most advantageously by making use of equipment such as the Model SCM 150S Holmberg Stripper Crimper which is marketed by the assignee of the present invention.

An important feature of the contact assembly 22 relates to the configuration of the constricted locking or retention portion 38 thereof. Locking portion 38 comprises first and second spaced apart wings or sidewalls 43, 44 which extend vertically above the center line of contact assembly 22, the forward portions of which are integral with the contact assembly 22 and have upstanding (vertically oriented) forward stop surfaces 45, 46 at the forward ends thereof. The rear portions 47, 48 of sidewalls 43, 44 are separated (slotted) along horizontal lines 49, 50 so that the upper halves of rear portions 47, 48 form first and second vertically extending spring locking beams 51, 52 which end at rear locking surfaces 53, 54, respectively. The locking beams 51, 52 are bent inwardly (i.e., they converge) so that the rear ends thereof, particularly the inner vertical edges of locking surfaces 53, 54 are in close proximity to or actually touching each other.

A further important feature of the contact assembly 22 relates to the vertical offset portion 39. Offset portion 39 serves to displace the horizontal (longitudinal) axis or center line of the contact pin 42 from the horizontal axis or center line of the crimp barrels 40, 41 (and the associated conductor 24). As will be explained below, the foregoing offset configuration, in combination with appropriate cavities 34a–34d, makes it possible to nest a plurality of contact assemblies 22 in an array in which the rearmost crimp barrel portions 41 are aligned along four (i.e., "2n") horizontal rows while the contact pins 42 are aligned along two (i.e., "n") horizontal rows. The vertical orientation of the contact assemblies 22 is the same for each pair of vertically aligned assemblies 22 but adjacent horizontal assemblies 22 are alternatively upright and inverted, as will appear more fully below.

Referring to FIG. 5, which is a partial cutaway view of the insulator base housing 26 and insulator cover 28, insulator material is cut away to expose two contact assemblies 22, 22' (corresponding to those inserted in numbered contact entry openings "3" and "27" in FIG. 3a).

An upper one of the contact assemblies 22 is shown fully inserted in a cavity 34a while a lower one of the contact assemblies 22' is shown partially inserted in a cavity 34d. The illustrated cavities 34a and 34d are horizontally offset from each other (they do not comprise a vertically aligned pair of openings) and therefore the lower contact assembly 22' is inverted while the upper contact assembly 22 is upright.

Figure 4:
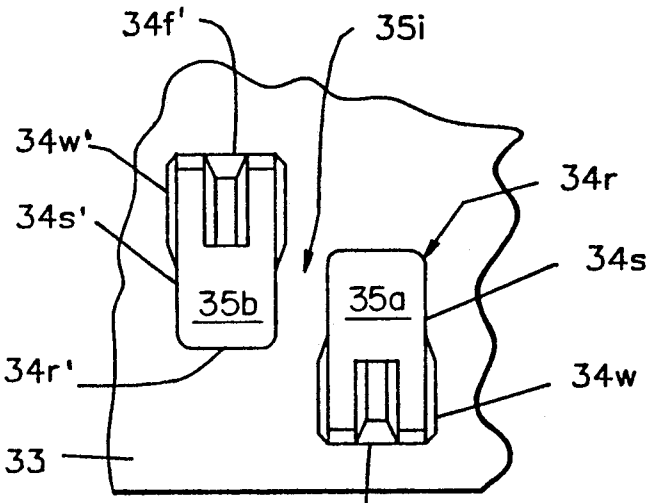
FIG. 4 is an enlarged view of two adjacent contact receiving openings in the rear face shown in FIG. 3*a* of the insulator housing.

Referring to FIG. 4, two of the contact entry openings 35a and 35b shown in FIG. 3a (corresponding to numbered openings "3" and "2") are shown to a greater scale for clarity. It should be noted that FIG. 3a is a rear view of insulator base 28 and therefore it, as well as FIG. 4 is inverted relative to its normal orientation in use. References to physical orientation (e.g., upper, lower, etc.) will hereinafter be made with respect to the normal orientation of the apparatus. Furthermore, each opening 35c is geometrically identical to a vertically paired opening 35a, but is displaced vertically from the corresponding opening 35a while each opening 35d is identical to, but is displaced vertically from, a vertically paired opening 35b.

As shown in FIG. 4, the end view looking into each of cavities 34a–d shows interior walls which form a cavity that is generally rectangular in shape, the rectangular shape of cavity 34a having a roof 34r, a floor 34f and two vertical side walls 34s. Corresponding portions of cavity 34b are designated by the same reference numerals followed by a prime (') symbol.

In order to accommodate the relatively large diameter of insulation crimp barrel 41 without compromising the thickness of the necessary insulation between adjacent contact assemblies, the width of the upper half of each of openings 35a, 35c is enlarged as indicated by the outwardly bowed wall portions 34w (see FIG. 4). The enlarged (relatively wide) half of the opening 35a commences at the rear surface 33 of insulator base housing 26 and extends into cavity 34a a sufficient distance to accommodate the full length of the outside dimension of insulator crimp barrel 41 (i.e., the walls 34w extend into cavity 34a at least about 0.40 inches). The shape of wall portions 34w approximates the substantially cylindrical shape of insulator crimp barrel 41 but may be made up of straight line segments, as illustrated, for ease of manufacturing and assembly. In order to provide a sufficient thickness of insulator material in the region 35i between adjacent openings, such as openings 35a and 35b, the horizontally adjacent openings 35a, 35b (or 35c, 35d) are offset vertically from each other and lie along a pair of rows, which rows are offset vertically from each other by a distance less than the height of contact entry openings 35a–d. Preferably, the vertical offset is one-half that height. Additionally, the center line of the row comprising contact entry openings 35a is offset vertically from the center line of the row comprising contact entry openings 35c (the same relationship exists between 35b and 35d) by a distance substantially 1.5 times the height of contact entry openings 35a–d. Furthermore, the horizontally adjacent cavities 34a, 34b (or 34c, 34d) are inverted with respect to each other so that the enlarged or relatively wide opening portions (represented by bowed wall portions 35w) of the adjacent openings 35a, 35b (or 35c, 35d) are not adjacent to each other but rather, are juxtaposed with the relatively narrower opening portions of the adjacent contact entry openings. Thus, a relatively narrow portion of each contact entry opening (which is wide enough to admit a contact pin 42) is adjacent the relatively wide portion of each adjacent contact entry opening. The desired high density of connectors is thereby achieved.

Figure 7:
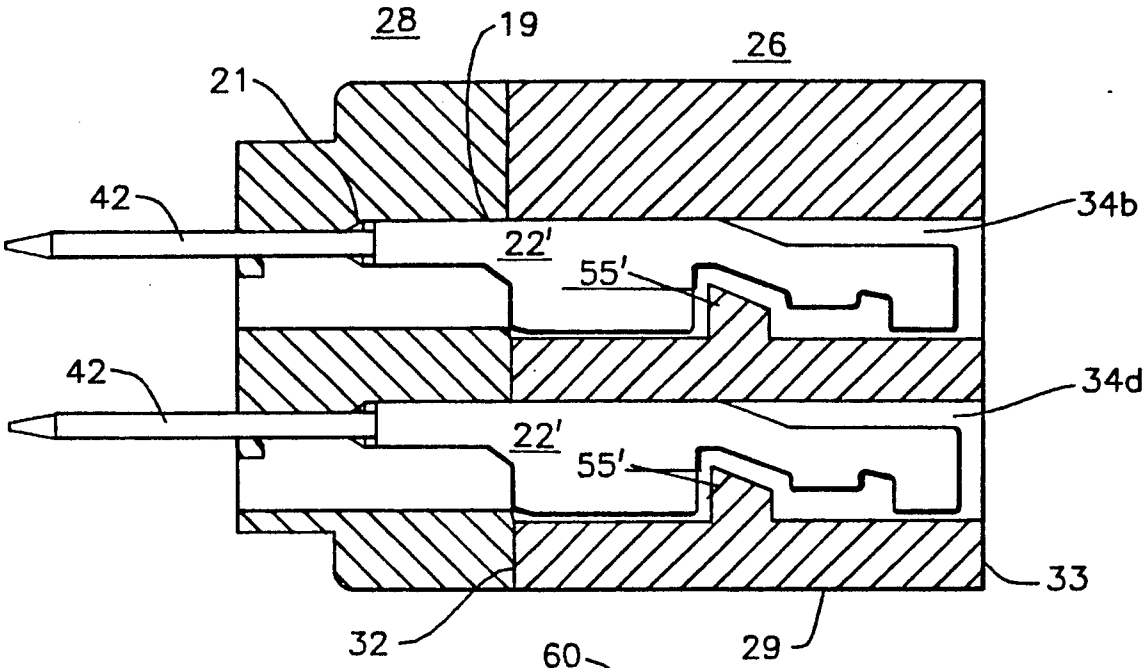
FIG. 7 is a broken away sectional view into the interior of a pair of vertically aligned contact receiving cavities of an insulator base housing and insulator cover constructed the present invention.
Figure 8:
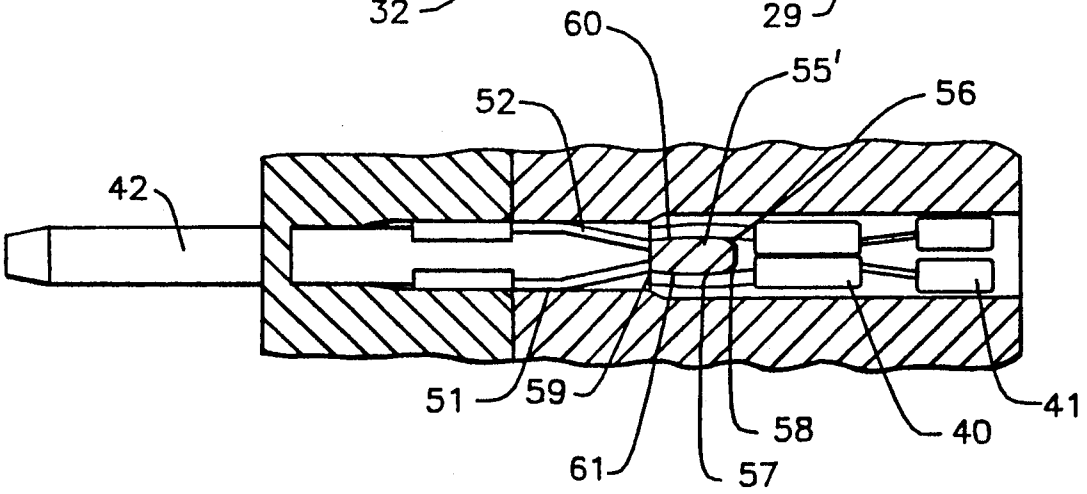
FIG. 8 is a partially broken away sectional top view into a contact receiving cavity constructed according to the present invention.

As can be seen best in connection with FIGS. 5 and 7, in order to retain contact assembly 22 or 22' within an appropriate cavity 34a or 34d, each cavity is formed with a retention rib 55 or 55' extending either downwardly or upwardly, as the case may be, into the cavity from a central portion of the wall of the cavity 34a or 34d. Each retention rib 55 or 55' preferably includes sloping (wedgeshaped) side surfaces 56, 57 which extend from a relatively narrow rearward facing area 58 to a pair of substantially parallel side walls 60, 61 which are spaced apart a distance slightly less than the opening or space between the inner surfaces of sidewalls 43, 44 of contact assembly 22. Side walls 60, 61 each terminate at a forward shoulder 59. The forward portions of side walls 60, 61 are of greater vertical extent than rearward facing area 58 in order to provide a shoulder 59 of desirably large area at the forward extreme of rib 55 and a relatively small area of initial contact between side surfaces 56, 57 and spring locking beams 50, 51. That is, the dimensioning and positioning of the retention rib 55 or 55' is arranged to guide, engage with and ultimately captivate (retain) the contact assembly 22 or 22' within cavity 34a or 34d. Each of the cavities of the type shown as cavity 34a or 34c has a downwardly extending retention rib 55 while each of the cavities of the type shown as cavity 34b or 34d has an upwardly extending retention rib 55'. In all other respects, the retention ribs 55, 55' are identical to each other.

As can be seen in FIG. 5, when a contact assembly 22' is inserted into the cavity 34d, the forward box-shaped contact portion 37 and contact pin 42 are placed adjacent the roof of the cavity 34d and the contact assembly 22' is slid forward. As the contact assembly 22' is inserted further, the vertical sidewalls 43, 44 of locking portion 38 enter the cavity 34d and their forwardmost portion passes over the sloping side surfaces 56, 57 of retention rib 55'. As the contact assembly 22' is inserted further into cavity 34d, the spring locking beams 51, 52, the rear ends 53, 54 of which are "closed", engage side surfaces 56, 57. Eventually, resistance will be encountered as a result of the spring force exerted by the locking beams 51, 52 as they are spread apart by engagement with rib 55'. Upon application of the necessary added insertion force (by a human or machine assembly device as the case may be), the locking beams 51, 52 will spread apart progressively as they pass along side walls 60, 61. The contact assembly 22' is inserted further until such time as the rearward extremity 53, 54 of the locking beams 51, 52 passes beyond the forward shoulder 59 of retention rib 55'. The spring force of the locking beams 51, 52 will thereupon cause the beams 51, 52 to return to their closed or converged position and the rearward extremities 53, 54 will engage shoulder 59 so as to captivate the contact assembly 22' in its cavity 34d.

The location of the locking beams 51, 52 adjacent the floor 34f (or 34f') of the cavity 34a or 34d makes it possible to provide a disassembly aperture 62 or 63, respectively, in the vicinity of the floor 34f (or 34f') either immediately above or immediately below a contact exit opening 64 in the insulator cover 28 (see FIG. 5). An appropriate tool may be inserted through aperture 62 or 63 into the particular cavity 34a-d between the open ends of locking beams 51, 52. The size of the tool (not shown) is selected so that upon its insertion, the tool will force the locking beams 51, 52 apart to an extent which will permit beams 51, 52 to ride along the side walls 60, 61 of retention rib 55 as backward pressure is exerted against contact assembly 22'. This arrangement permits removal of the contact assembly 22' for repairs or other needs.

As can be seen in FIGS. 2 and 3c, the front mating surface 32 of insulator base housing 26, similar to rear contact receiving surface 33 (FIG. 3a) includes four rows of openings (the different openings in the rows being designated by the reference numerals 36a-d). The substantially rectangular surface of forward shoulder 59 of each of the retention ribs 55, 55' can be seen when looking into the openings 36a-d. As can be seen in FIGS. 5 and 7, when the contact assemblies 22, 22' are inserted into the cavities 34a-34d, the forward stop surfaces 53, 54 of locking portion 38 of each of the contact assemblies 22, 22' are positioned substantially at the front mating surface 32. The forward box-shaped portion 37 and contact pin 42 of each contact assembly 22, 22' then extends into and through an associated contact cavity 28a-d in insulator cover 28.

The contact cavities 28a and 28c in cover 28 are vertically aligned in pairs, are similarly shaped but are vertically displaced from each other. The contact cavities 28b and 28d are vertically aligned in pairs, are similar in shape to each other, are vertically displaced from each other and are alternately disposed with respect to cavities 28a, 28c along two rows or horizontal lines extending across the insulator cover 28. A detailed view through two adjacent contact entry openings 23a and 23b in a rear contact receiving surface 23 of insulator cover 28 is shown in FIG. 9.

Figure 9:
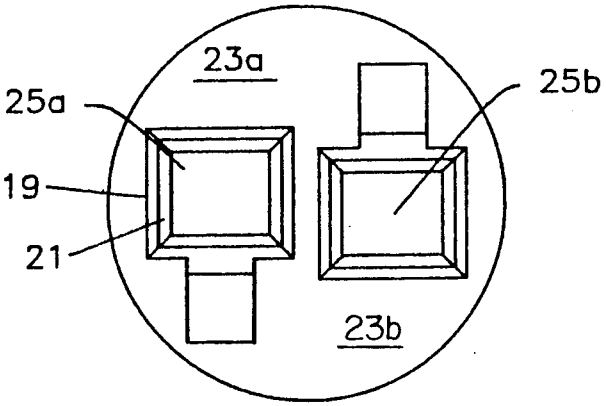
FIG. 9 is an enlarged view of two adjacent contact receiving openings on the rear face of the insulating cover of an assembly constructed according to the present invention.

The innermost rectangular shape associated with each of openings 23a, 23b in FIG. 9 corresponds to openings 25a, 25b in the forward face of insulator cover 28 for accepting contact pins 42 (e.g., an opening 25a of 0.026×0.018 inches will be suitable to accept a pin 42 having nominal measurements of 0.024×0.0156 inches). As can be seen in FIGS. 5 and 7-9, rearward facing inner and outer beveled surfaces 21 and 19, respectively provided at appropriate distances within cavities 28a-d are dimensioned to interface, respectively, with the forward end of box-shaped portion 37 and the forward stop surfaces 45, 46 of a contact assembly 22 or 22'. The beveled surfaces 21, 19 also serve to guide or facilitate inserting the contact pin 42 into the cavities 28a-d in insulator cover 28.

As noted above, in order to remove a contact assembly 22, 22', a tool (not shown) is inserted through insulator cover 28 to open the spring locking beams 51, 52. Means are provided for insertion of such a tool comprising access openings 62, 63 which are provided alternately above and below the contact pin openings 25a, 25b (see FIG. 5).

While the several aspects of the present invention have been described in connection with an integrated contact assembly, it will be recognized by those skilled in the art that various modifications and subcombinations of the described arrangements may also be advantageously applied to this technological field. The several aspects of the invention are set forth in the following claims.

What is claimed is:

1. An electrical connector comprising:

a plurality of elongate conductive contact assemblies disposed in a geometric array, each contact assembly comprising at least a conductive contact portion, a conductor connection portion rearward of the contact portion and a retention portion intermediate the contact portion and the connection portion, the contact portions of the plurality of assemblies being adapted to be disposed in side by side positions along n rows across the connector where n is an integer;

an insulative housing having at least a rear wall, a forward wall and a plurality of contact assembly support cavities extending between said rear and forward walls, each said support cavity having a contact retention means disposed intermediate said rear and forward walls for engaging said retention portion of an associated contact assembly; each said support cavity having an elongate contact entry opening of a predetermined height in said rear wall, each said contact entry opening including a relatively wide portion and a relatively narrow portion for receiving, respectively, a relatively wide conductor connection portion and a relatively narrow contact portion of the associated contact assembly, said entry openings being disposed along n pairs of rows in a staggered array, with adjacent cavities in each pair of rows being alternately upright and inverted, the entry openings for upright cavities in each pair of rows lying along a first center line and the entry openings for inverted cavities in the same pair of rows lying along a second center line offset from said first center line by a distance less than the height of said contact entry openings such that said inverted and upright cavities in a pair of rows are interleaved.

2. An electrical connector according to claim 1 wherein said relatively wide portions are alternatingly disposed in upper and lower halves of adjacent contact entry openings in each said pair of rows.

3. An electrical connector according to claim 2 wherein:

said relatively wide portion of each said contact entry opening is juxtaposed with relatively narrow portions of adjacent contact openings in each said pair of rows.

4. An electrical connector according to claim 1 wherein:

n is equal to two; and the entry openings for upright cavities in a first pair of rows lying along a first center line, the entry openings for inverted cavities in said first pair of rows lying along a second center line offset from said first center line, the entry openings for upright cavities in a second pair of rows lying along a third center line offset from said second center line and the entry openings for inverted cavities in said second pair of rows lying along a fourth center line offset from said third center line, said first and second center lines being offset from each other and said third and fourth center lines being offset from each other by a distance less than the height of said contact entry openings such that said inverted and upright cavities in a pair of rows are interleaved.

5. An electrical connector according to claim 4 wherein:

upright cavities in said first pair of rows are aligned with upright cavities in said second pair of rows and inverted cavities in said first pair of rows are aligned with inverted cavities in said second pair of rows.

6. An electrical connector according to claim 4 wherein:

said second and third center lines are offset from each other by a distance substantially equal to or greater than the heights of said contact entry openings.

7. An electrical connector according to claim 2 wherein:

each said conductive contact assembly comprises a crimp/snap contact assembly further having an offset portion intermediate said contact portion and said connection portion and disposed at an angle with respect to a longitudinal axis of said contact assembly for displacing said contact portion from said connection portion in a direction substantially perpendicular to said axis.

8. An electrical connector according to claim 7 wherein:

said connection portion comprises a generally tubular member adapted for crimp engagement with a conductor and said contact portion comprises a generally tubular member for engagement with an elongated contact pin.

9. An electrical connector according to claim 7 wherein:

alternate ones of said crimp/snap contact assemblies are inverted such that connection portions of adjacent ones of said contact assemblies are displaced alternately in opposite directions from their respective longitudinal axes.

10. In an electrical connector adapted for supporting a plurality of elongate conductive contact assemblies in a geometric array, each contact assembly comprising at least a conductive contact portion, a conductor connection portion rearward of said contact portion and a retention portion intermediate said contact portion and said connection portion, said contact portions of said plurality of assemblies being adapted to be disposed in side by side positions along n rows across said connector, where n is an integer, an insulative housing comprising:

at least a rear wall, a forward wall and a plurality of contact assembly support cavities extending between said rear and forward walls, each said support cavity having a contact retention rib disposed intermediate said rear and forward walls and adapted to engage said retention portion of an associated contact assembly;

each said support cavity having an elongate contact entry opening with a predetermined height in said rear wall, each said contact entry opening including a relatively wide portion and a relatively narrow portion for receiving, respectively, a relatively wide connector connection portion and a relatively narrow contact portion of the associated contact assembly, said entry openings being disposed along n pairs of rows in a staggered array, with adjacent cavities in each pair of rows being alternately upright and inverted, the entry openings for upright cavities in each pair of rows lying along a first center line and the entry openings for inverted cavities in the same pair of rows lying along a second center line offset from said first center line by a distance less than the height of said contact entry openings such that said inverted and upright cavities in a pair of rows are interleaved.

11. An insulative housing according to claim 10 wherein said relatively wide opening portions are alternatingly disposed in upper and lower halves of adjacent contact entry openings in each said pair of rows.

12. An insulative housing according to claim 10 wherein:

said relatively wide portion of each said contact entry opening is juxtaposed with relatively narrow portions of adjacent contact openings in each said pair of rows.

* * * * *